United States Patent [19]

Narozny

[11] 3,990,767

[45] Nov. 9, 1976

[54] ELECTRICAL CONTACT AND CONNECTOR MEANS EMPLOYING SAME

[75] Inventor: Ronald S. Narozny, Panorama City, Calif.

[73] Assignee: Thomas & Betts Corporation, Elizabeth, N.J.

[22] Filed: July 11, 1975

[21] Appl. No.: 595,125

[52] U.S. Cl. ..... 339/198 R; 339/97 P

[51] Int. Cl.[2] ..... H01R 9/00

[58] Field of Search ..... 339/97 R, 97 P, 98, 339/99 R, 223 S, 265 R, 198 R

[56] References Cited

UNITED STATES PATENTS

| | | | |
|---|---|---|---|
| 3,444,506 | 5/1969 | Wedekind | 339/99 R |
| 3,447,119 | 5/1969 | Goodall | 339/265 R |
| 3,594,712 | 7/1971 | Enright | 339/198 R |
| 3,860,318 | 1/1975 | Reavis et al. | 339/99 R |
| 3,918,789 | 11/1975 | Davis | 339/223 S |

FOREIGN PATENTS OR APPLICATIONS

| | | | |
|---|---|---|---|
| 1,963,313 | 6/1971 | Germany | 339/97 R |

*Primary Examiner*—Gerald A. Dost

*Attorney, Agent, or Firm*—David Teschner; Jesse Woldman

[57] ABSTRACT

A double-ended electrical contact includes a selectively bendable central portion arranged to permit the opposing ends of the contact to be selectively offset from one another along parallel axes and generally within a common plane. In one embodiment, the central portion comprises a pair of spaced struts connecting the two ends of the contact together and arranged to define a parallelogram to retain the original axial orientation of each end of the contact after offset. The contacts may be selectively offset and disposd in a contact housing having differently pitched apertures in its upper and lower portions, respectively, to provide mating electrical engagement between differently pitched conductive elements such as a flat cable having a first given spacing between conductors, and a pin or socket connector having a second given spacing between its elements different than the spacing between the flat cable conductors.

15 Claims, 15 Drawing Figures

ELECTRICAL CONTACT AND CONNECTOR MEANS EMPLOYING SAME

BACKGROUND OF THE INVENTION

1. Field of the Invention

The invention is directed to the field of electrical connecting devices for use with different pitched conductive elements.

2. Description of the Prior Art

Because of its economy, convenience, and ease of manipulation as a wiring means for electrically interconnecting spaced components, planarly laminated or flat cable has enjoyed increased popularity in recent years. However, in many cases, the spacing between the conductors of the cable may be different than that between the elements of a connector to which the cable is to be terminated, thereby necessitating a time consuming and laborious slitting operation whereby the insulation of the cable is slit intermediate each of the conductors so that the ends of the conductors may be re-spaced to conform to pitch of the connector elements. Such manual slitting operations must furthermore, be carried out with extreme care to insure that the integrity of the insulating layers is maintained after the assembly is completed. However, the completed assembly thus results in a rather crude, nonuniform cable contour which is not only unsightly, but may lead to undesirable effects when employed in certain high frequency applications. One prior art device for providing an interconnection between differently pitched elements is disclosed in U.S. Pat. No. 3,777,299 issued Dec. 4, 1973 to Nickerson et al, and assigned to the assignee of the instant invention. This device, however, requires a rather complex arrangement of molded or formed components particularly adapted to provide a connection between differently pitched conductive elements in which the respective pitches are even multiples of one another. Accordingly, such device fails to provide the versatility and necessary for many applications in which uneven or non-integral pitch ratios are encountered.

SUMMARY OF THE INVENTION

The invention overcomes the limitations and difficulties noted above with respect to prior art devices by providing a double-ended offsetable electrical contact and a housing therefore which is more versatile, economical, and simpler than such prior art devices. The electrical contact comprises a pair of opposing end portions which are joined by a bendable central portion constructed to permit the end portions of the contact to be selectively offset from one another along parallel axes while retaining their original axial orientation with respect to a common longitudinal axis. The central portion comprises, in one embodiment, a pair of spaced, beam-like struts joining the opposing ends of the contact to one another and providing both electrical and mechanical continuity therebetween. The ends of the struts are fixedly attached to the respective contact end portions and are bendable at the juncture therebetween to permit, where necessary, the respective contact end portions to be manually offset from one another along parallel axes by grasping each end portion and applying a force thereto opposite but parallel to the force applied to the opposing end portion. The area encompassed by the struts is thus reformed from an essentially rectangular shape to a parallelogram, in which the distance between the end portions of the contact is decreased in proportion to the length of the struts, but in which the original axial orientation of the individual end portions with respect to the central longitudinal axis of the contact is maintained irrespective of the degree or extent of offset. Each contact end portion may be selectively configured in a variety of shapes to provide for convenient attachment thereto by bonding, piercing, or through mating interengagement with a pin or socket element. The offsetable feature is advantageously employed in combination with a suitably structured contact housing having selectively pitched apertures located in the upper and lower portions thereof, each of the apertures being proportioned to accept a respective end portion of the electrical contact which may be selectively offset according to its position with respect to a central plane bisecting the housing. Accordingly, similar end portions of the contacts may be disposed at a first pitch in one series of contact housing apertures, while the other end portions of the contacts are disposed at a second pitch in the opposing series of contact housing apertures, the aperture pitches being designed to conform to the pitch of the particular conductive components to which the contacts are to be attached. For the sake of symmetry, the contacts may be assembled in the contact housing in pairs having counterparts on either side of the central plane of the contact housing, each of such pair of contacts having an essentially equal but opposite degree of offset. It is therefore an object of this invention to provide an improved electrical contact and connector means employing same.

It is another object of this invention to provide a means for electrically interconnecting a first component having its conductive elements separated by a first given spacing to a second component having its conductive elements separated by a second given spacing.

It is a further object of this invention to provide a dual pitch connector.

It is yet another object of this invention to provide a means for selectively offsetting the opposing ends of a dual-ended electrical contact.

It is yet a further object of this invention to provide an electrical contact for a dual pitch connector.

It is still another object of this invention to provide a means for terminating a flat cable to a dual-pitch connector.

It is still a further object of this invention to provide a symmetrically constructed dual-pitch connector.

It is yet another object of this invention to provide a means for selectively displacing the opposing ends of a dual-ended electrical contact to either side of a central longitudinal axis.

It is still another object of this invention to provide a means for selectively equally displacing the opposing ends of a dual-ended electrical contact to either side of a central longitudinal axis.

Other objects and features will be pointed out in the following description and claims and illustrated in the accompanying drawings which disclose, by way of example, the principle of the invention and the best mode contemplated for carrying it out.

BRIEF DESCRIPTION OF THE DRAWINGS

In the Drawings.

Similar elements are given similar reference characters in each of the respective drawings.

DESCRIPTION OF THE PREFERRED EMBODIMENTS

Figure 1:
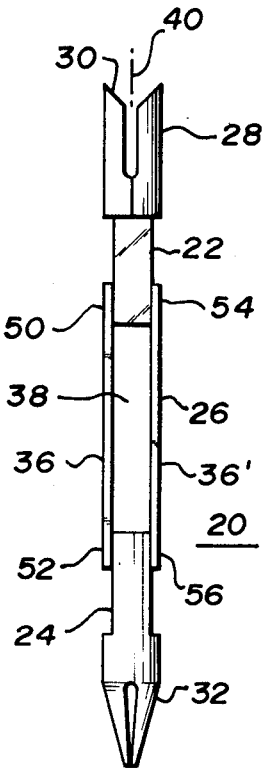
FIG. 1 is a front elevational view of an electrical contact constructed in accordance with the concepts of the invention.
Figure 2:
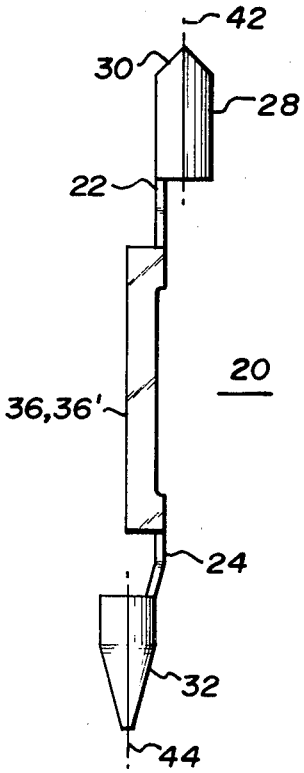
FIG. 2 is a side elevational view of the contact of FIG. 1.
Figure 3:
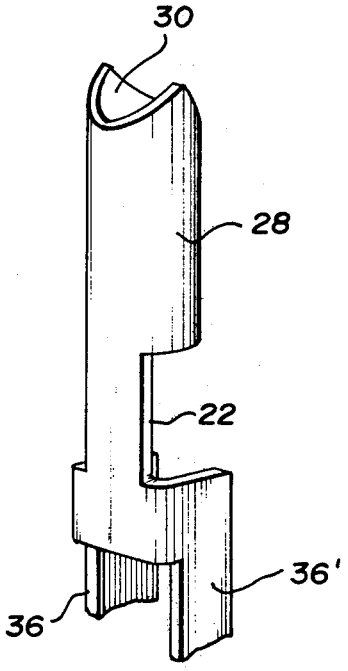
FIG. 3 is a fragmentary perspective view of the contact of FIG. 1.
Figure 4:
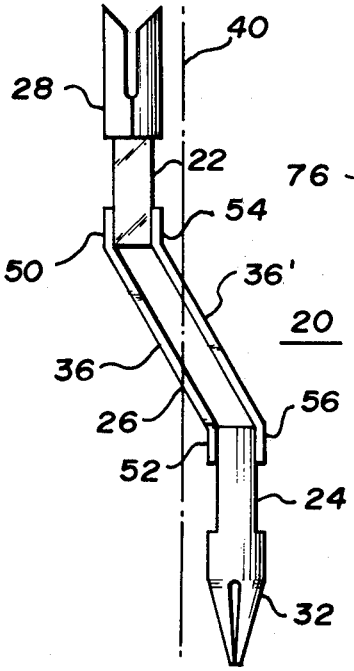
FIG. 4 is a front elevational view of the contact of FIG. 1 showing the ends thereof offset from its longitudinal axis.
Figure 5:
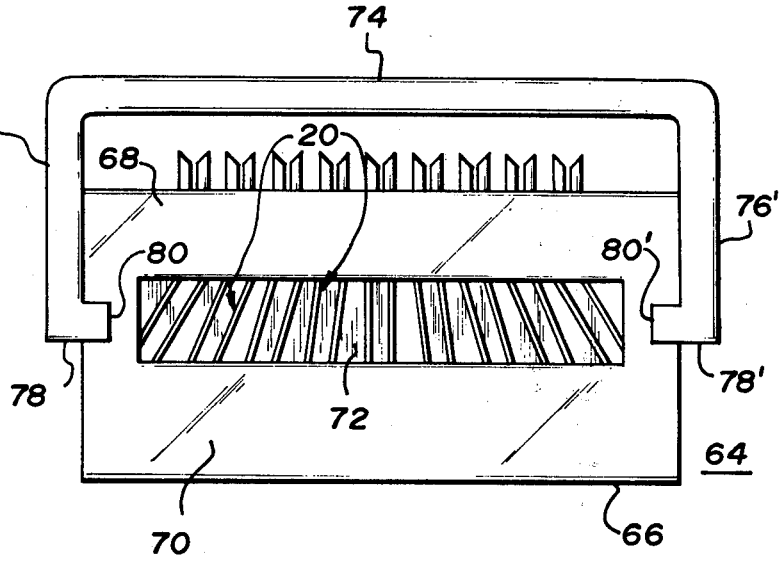
FIG. 5 is a front elevational view of a connector means employing the contact of FIG. 1 in accordance with the concepts of the invention.
Figure 10:
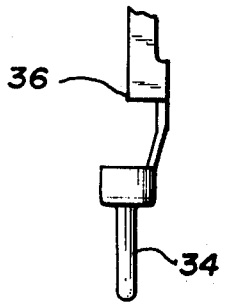
FIG. 10 is a fragmentary side elevational view of a further embodiment of one end of an electrical contact constructed in accordance with the concepts of the invention.
Figure 11:
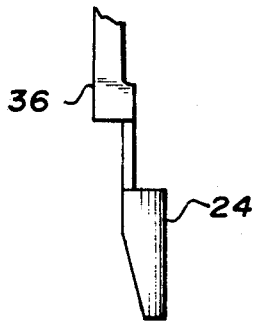
FIG. 11 is a fragmentary side elevational view of another embodiment of one end of an electrical contact constructed in accordance with the concepts of the invention.
Figure 12:
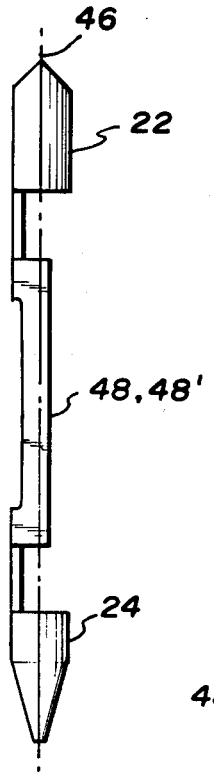
FIG. 12 is a side elevational view of a further embodiment of an electrical contact constructed in accordance with the concepts of the invention.
Figure 13:
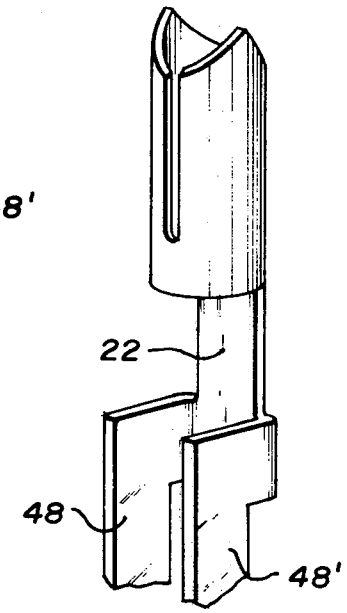
FIG. 13 is a fragmentary perspective view of a portion of the device of FIG. 12.
Figure 14:
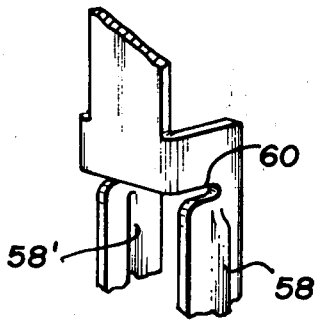
FIG. 14 is a fragmentary perspective view of a further embodiment of the struts of an electrical contact constructed in accordance with the concepts of the invention.
Figure 15:
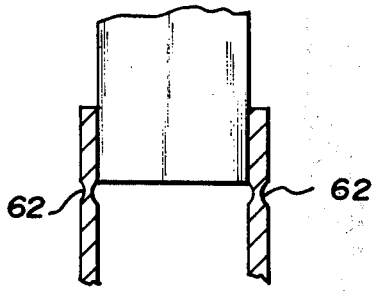
FIG. 15 is a fragmentary front elevational view of another embodiment of the struts of an electrical contact constructed in accordance with the concepts of the invention.

Turning now to FIGS. 1, 2, 3, and 4 there is shown an electrical contact 20 constructed in accordance with the concepts of the invention, and comprising a first conductor engaging end portion 22, a second conductor engaging end portion 24, and a central portion 26 interconnecting the end portions 22 and 24. In the particular embodiment shown in FIGS. 1 through 4, the first end portion 22 comprises a tubular segment 28 having sharpened edges 30 at its free end, which edges may be effectively employed as insulation piercing and conductor engaging means, as more fully described in my copending application Ser. No. 499,588 filed Aug. 22, 1974 and assigned to the assignee of the instant invention. The second end portion 24 comprises a tapered tubular pin receiving socket 32. Either or both end portions 22 and 24 may, of course, be modified, to provide other arrangements thereat such as a pin means 34 shown in FIG. 10, at either or both ends, a socket such as 32 at both ends, an insulation piercing tubular segment 28 at both ends, or suitable solder tabs (not shown) at either or both ends. The central portion 26 includes a pair of spaced parallel struts 36, 36′ bordering a rectangular opening 38 therebetween. The struts 36 and 36′ are planarly disposed generally normal to the plane of the opening 38, as more clearly shown in FIGS. 2 and 3, to provide a preferred direction of bend as will be described in greater detail hereafter. The first and second end portions 22 and 24 are arranged initially to lie within a common plane 40 (FIG. 1), with each of the end portions 22 and 24 being axially disposed either along parallel but offset axes 42 and 44, as shown in FIG. 2, or along a single common axis 46, as shown in FIGS. 11 and 12, either embodiment serving the same purpose, according to the application and the locational requirements of the user. The end portions 22 and 24 may, of course, be reversed in position from that shown in FIG. 12 so that both lie along a common axis such as 44 located rearwardly of the struts 36, 36′, in FIG. 2. The struts 36, 36′, although shown in FIG. 2 as folded behind the upper or first end portion 28 of contact 20, may be positionally reversed in the manner shown in FIGS. 12 and 13 wherein there is illustrated a pair of struts 48, 48′ bordering the axis 46 bisecting the first and second contact end portions 22 and 24. Returning now to FIGS. 1, 2, 3, and 4, the struts 36, 36′ each comprise respective end portions 50, 52 and 54, 56, which are rigidly affixed to the respective first and second end portions 22 and 24 of the contact 20, so that as the contact end portions 22 and 24 are grasped and respective forces applied thereto in a direction normal to the plane 40, or to the left and right thereof, as viewed in FIG. 1, the struts 36, 36′ will tend to bend at the juncture between their respective end portions 50, 52, 54, and 56 and the contact end portions 22 and 24, substantially as shown in FIG. 4, and within a common plane parallel to the plane of the illustration of FIG. 4 and normal to the plane 40. The central portion 26 of the contact 20 is thus caused to define a parallelogram whereby each contact end portion 22, 24 has been offset to either side of the central longitudinal axis of the contact 20. Additionally, as a result of the parallelogram configuration, each contact end portion 22, 24 is merely shifted laterally to a respective side away from the plane 40 while undergoining no angular shift with respect to the central longitudinal axis of the contact 20. Thus, the contact end portions 22 and 24 may be offset from one another to almost any desired degree while their longitudinal axes remain parallel to one another, and lie either in a common plane or in parallel planes. Where necessary or desirable, each of the struts 36, 36′ may be provided with stiffening means which may comprise ribs such as 58 and 58′ (FIG. 14) which may be conveniently formed integrally with each strut by coining or the like. The ribs 58 and 58′ extend along the length of each strut and terminate just short of each end portion thereof so as to selectively rigidify the strut without interfering with its bending characteristics at its juncture with a respective contact end portion 22 and 24. The ribs 58, 58′ may, of course, be replaced with flanges or other like stiffening means where necessary, desirable, or preferred. To further enhance bending at the desired location, each strut 36, 36′ may be provided with a weakened section such as one or more notched portions 60 (FIG. 14) arranged to selectively reduce the width of the strut thereat, or one or more transverse recessed portions 62 (FIG. 15) arranged to selectively reduce the thickness of the strut thereat.

Figure 6:
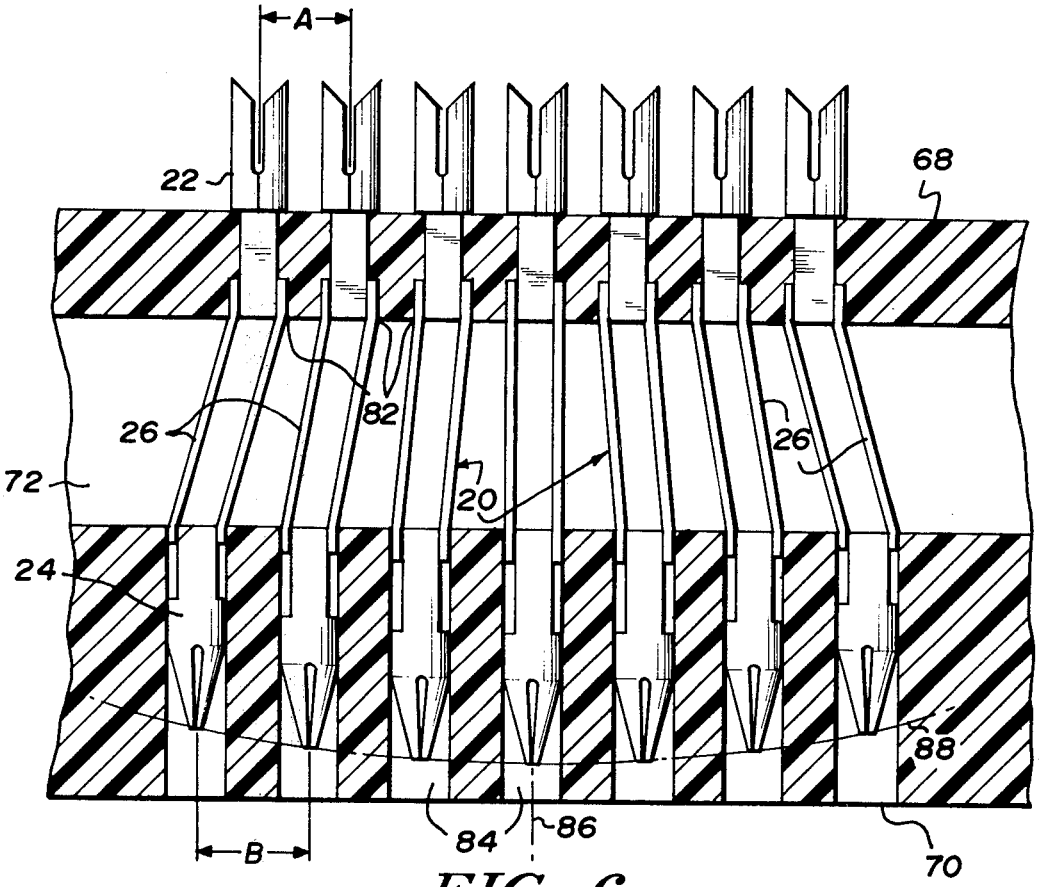
FIG. 6 is an enlarged fragmentary front elevational view, partly in section, of a portion of the connector means of FIG. 5.
Figure 7:
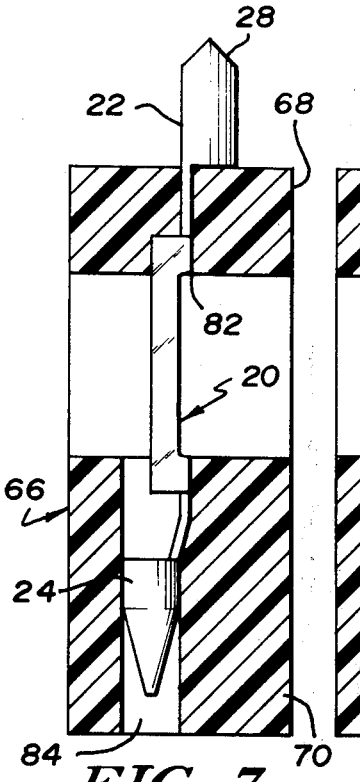
FIG. 7 is a side elevational view, partly in section, of a portion of the device of FIG. 5.
Figure 8:
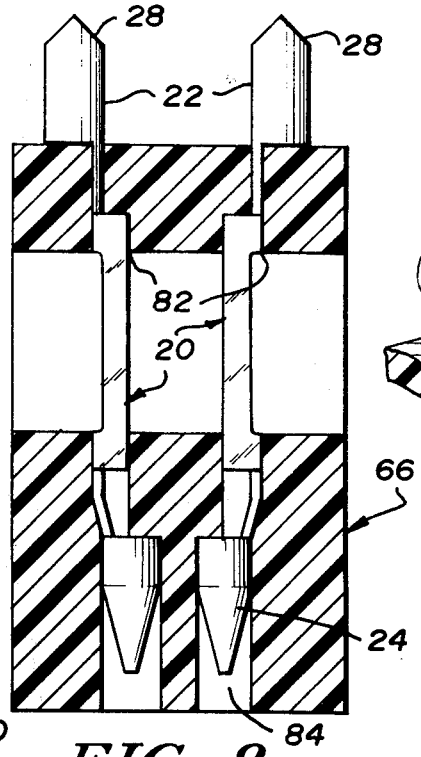
FIG. 8 is a side elevational view, partly in section, of a portion of a further embodiment of a connector means employing the contact means of FIG. 1.
Figure 9:
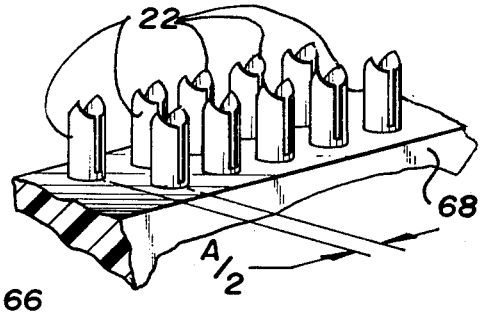
FIG. 9 is a fragmentary perspective view, partly in section, of an embodiment of an upper portion of a connector means constructed in accordance with the concepts of the invention.

Turning now to FIGS. 5, 6, 7, 8, and 9 there is shown an electrical connecting device 64 constructed in accordance with the concepts of the invention and including a plurality of electrical contacts 20 therein. The connecting device 64 is formed from an electrically insulating dielectric material and comprises an elongate contact housing 66 having an upper portion 68 and a lower portion 70 preferably spaced apart from one another to define a chamber 72 therebetween. In the particular embodiment illustrated in FIG. 5, a cap member 74 overlies the upper portion 68 of the housing 66 and is detachably coupled thereto by arms 76, 76' each having an inturned portion 78, 78', respectively, engaging a respective notch 80, 80' located at either end of the housing 66. The upper portion 68 of the housing 66 is provided with a series of aligned first transverse apertures 82 extending along the length of the upper portion 68 and preferably uniformly spaced from one another a first given distance A (FIG. 6) thereby defining the pitch of the apertures 82. The lower portion 70 of the housing 66 is similarly provided with a series of aligned second transverse apertures 84 extending along the length of the lower portion 70 and preferably uniformly spaced from one another a second given distance B (FIG. 6) thereby defining the pitch of the apertures 84. In the embodiment illustrated in FIGS. 5 through 9, the pitch B is greater than the pitch A and may differ therefrom in any desired ratio. For example, the apertures 82 may be located on 0.050 inch centers, while the apertures 84 may be located on 0.070 inch centers, each designed to conform to the spacing between a particular array of contacts or conductor elements (not shown) to be interconnected by the device 64. Each series of apertures 82 and 84 lie along a common axis, which axes are either vertically aligned with one another or offset from each other depending upon the particular configuration of electrical contact to be employed in the housing 64, the latter arrangement being shown in FIGS. 5 through 9 as adapted to the receipt of the series of contacts 20 described heretofore. The apertures 82 and 84 may also be selectively arranged to extend uniformly to either side of a transverse plane 86 (FIG. 6) generally bisecting the housing 66 through its width. The contacts 20 are located in the housing 66 substantially as shown in FIG. 6 whereby their first end portions 22 extend within the upper portion apertures 82, and their second end portions 24 extend within the lower portion apertures 84. The central portions 26 of the contacts 20 are located within the chamber 72 intermediate the upper and lower portions 68 and 70, respectively, the chamber 72 providing a clearance for the central portions 26 of the contacts 20 so that each may be offset to the desired degree. Although not shown, it will be understood that the chamber 72 may be eluminated and the upper and lower portions 68 and 70 of the contact housing 66 extended in thickness so as to provide an esentially solid member having a series of molded or preformed channels or passageways (not shown) conforming generally to the shape and offset of the contacts 20. For the sake of symmetry and to limit the maximum degree of offset required for a particular application, the contacts 20 may be arranged in the housing 20 in pairs, each one of a pair having a counterpart on the opposite side of the bisecting plane 86, as shown in FIG. 6. Thus, except for the contact 20 located along the central plane 86, each contact 20 located a given distance to the left of the plane 86, as viewed in FIG. 6, has a counterpart located the same distance to the left of the plane 86, as viewed in FIG. 6, has a counterpart located the same distance to the right of the plane 86, and the first and second end portions 22 and 24, respectively, of the left hand contact will be equally but oppositely offset from one another in relation to its counterpart right hand contact 20. Furthermore, the degree of offset between the first and the second end portions 22 and 24, respectively, of each contact 20 will be directly proportioned to the distance of the contact 20 from the central plane 86. This arrangement may, of course, be readily repeated for more than one row of contacts 20, as exemplified in FIGS. 8 and 9, where there is shown two parallel rows of contacts 20 each extending along the length of the contact housing 66. In the particular embodiment illustrated in FIG. 9, the two rows of contacts 20 are arranged in a longitudinally staggered array with respect to one another so that the first end portion 22 of a contact 20 in one row is longitudinally displaced a distance or pitch equivalent to A/2 from the first end portion 22 of a contact 20 in the other row. Similarly, although not shown, the second end portion 24 of a contact 20 in one row, is longitudinally displaced a distance or pitch equivalent to B/2 from the second end portion 24 of a contact 20 located in the other row. The staggered arrangement may be advantageously employed where the tubular segments 28 of the first end portions 22 of the contacts 20 are designed to engage the conductor of a flat cable in which the conductors are spaced a distance or pitch equivalent to A/2 from each other while the tubular segments 28 in each row of contacts 20 are spaced a distance or pitch equivalent to A from each other, thus providing a greater degree of isolation and, consequently, a higher permissible voltage gradient between adjacent contacts 20. Where necessary or desirable, additional rows of contacts 20 may be added in a similar manner to accommodate more closely spaced elements. It should be further understood that although the particular contact configuration illustrated in FIGS. 1 through 4 is shown employed in the device of FIGS. 5 through 9, any of the contact arrangements including dual-pin, dual-socket, or combinations thereof described above may be substituted therefor without departing from the spirit of the invention and within the concepts herein disclosed. In each case, the apertures 82 and 84 will be suitably dimensioned to receive a corresponding contact end portion therewithin. It will be further understood that although essentially linear arrays of contacts have been shown, the contacts may be arranged in other suitable patterns such as circular, elliptical, and like non-linear configurations within the concepts herein disclosed. It should be further appreciated that, as a result of the differences in offset between adjacent contacts 20, the contacts 20 are caused to be forshortened in length in proportion to the degree of offset, so that, in the embodiment illustrated in FIGS. 5 and 6, the second end portions 24 of the contacts 20 describe an arcuate path 88 between the ends of the housing 66, the second end portion 24 of the central contact 20 being located at the center of the path 88. Where the first end portions 22 of the contacts 20 are employed to engage a flat cable (not shown) the cap member 74 serves firstly to provide an anvil to simultaneously force each of the cable conductors against the edges 30 of the tubular segments 28. After the tubular segments 28 have penetrated the insulation and engaged the conductive portions of the conductors of the flat cable, the cap member 74 serves to provide a protective covering and strain relief over the terminated portion of the cable.

The embodiments of the invention in which an exclusive property or privilege is claimed are defined as follows:

1. An electrical contact comprising: an elongate member having a first conductor engaging end portion, a second conductor engaging end portion, and a central portion connecting said first end portion to said second end portion, said central portion comprising a pair of spaced parallel struts each terminating in end portions rigidly affixed to a respective one of said conductor engaging end portions and bendable thereat in preferred direction within a common plane so that said first conductor engaging end portion and said second conductor engaging end portion may be selectively axially offset form one another in a direction parallel to said common plane, said struts generally defining a parallelogram after bending so that the original axial orientation of each of said first and said second conductor engaging end portions is maintained irrespective of the degree of axial offset therebetween, each of said struts comprising a generally flat elongate element, each of said struts comprising stiffening means disposed intermediate said end portions thereof.

2. An electrical contact as defined in claim 1 wherein said stiffening means comprises rib means.

3. An electrical contact as defined in claim 2 wherein said rib means is formed integral with said strut.

4. An electrical contact as defined in claim 1 wherein each of said struts further comprises a weakened section located at the junction between its end portion and a respective one of said first and second conductor engaging end portions to further control the point at which said struts will bend.

5. An electrical contact as defined in claim 4 wherein said weakened section comprises a notched portion reducing the width of said strut thereat.

6. An electrical contact as defined in claim 4 wherein said weakened section comprises a recessed portion reducing the thickness of said strut thereat.

7. An electrical connecting device comprising: an elongate contact housing having an upper portion and a lower portion; there being a series of first transverse apertures extending through said upper portion of said contact housing and aligned along a first common axis; there being a series of second transverse apertures extending through said lower portion of said contact housing and aligned along a second common axis, said first common axis and said second common axis extending generally parallel to one another, said series of first transverse apertures being spaced from one another a first given distance, said series of second transverse apertures being spaced from one another a second given distance different than said first given distance, each aperture of said series of first transverse apertures being selectively aligned with a corresponding aperture of said series of second transverse apertures along a predetermined axis and thereby defining a series of pairs of apertures; and a series of electrical contacts, one for each of said pairs of apertures, each of said contacts comprising an elongate member having a first conductor engaging end portion, a second conductor engaging end portion, and a central portion connecting said first end portion to said second end portion, said central portion comprising a pair of spaced parallel struts each terminating in end portions rigidly affixed to a respective one of said conductor engaging end portions and bendable thereat in a preferred direction within a common plane so that said first conductor engaging end portion and said second conductor engaging end portion may be selectively axially offset from one another in a direction parallel to said common plane, each of said contacts being disposed between a corresponding one of said pairs of apertures in said contact housing so that said first conductor engaging end portion extends within a corresponding one of said first transverse apertures and said second conductor engaging end portion extends within a corresponding one of said second transverse apertures, said central portion of said contact being aligned with said predetermined axis, whereby said first conductor engaging end portions of said contacts are spaced from one another said first given distance, and said second conductor engaging end portions of said contacts are spaced from one another said second given distance so that said first conductor engaging end portions may be connected to conductive elements having a spacing therebetween generally equal to said first given distance, and said second conductor engaging end portions may be connected to conductive elements having a spacing therebetween generally equal to said second given distance.

8. An electrical connecting device as defined in claim 7 wherein said series of first transverse apertures and said series of second transverse apertures extend to either side of a central transverse plane generally bisecting said contact housing.

9. An electrical connecting device as defined in claim 8 wherein said first conductor engaging end portion and said second conductor engaging end portion of a particular one of said electrical contacts located a given distance to one side of said central plane are axially offset from one another to an extent generally equal but opposite to the extent of axial offset between said first conductor engaging end portion and said second conductor engaging end portion of another particular one of said electrical contacts which is located the same given distance to the other side of said central plane.

10. An electrical connecting device as defined in claim 8 wherein the extent of offset between said first conductor engaging end portion and said second conductor engaging end portion of said electrical contacts increases in proportion to the increase in distance of said electrical contacts from said central plane.

11. An electrical connecting device as defined in claim 7 wherein said struts of said electrical contact generally define a parallelogram after bending so that the original axial orientation of each of said first and said second conductor engaging end portions is maintained irrespective of the degree of axial offset therebetween.

12. An electrical connecting device as defined in claim 7 wherein said contact housing upper portion is spaced apart from said contact housing lower portion, there being a chamber therebetween, said struts of said electrical contacts being located at least partially within said contact housing chamber.

13. An electrical connecting device as defined in claim 12 further comprising a cap member disengageably coupled to said contact housing adjacent said upper portion and overlying said first conductor engaging end portions of said electrical contacts.

14. An electrical connecting device as defined in claim 7 wherein said first conductor engaging end portions of said electrical contacts each terminate in a tubular portion located external to a corresponding one of said first transverse apertures.

15. An electrical connecting device as defined in claim 7 wherein said second conductor engaging end portions of said electrical contacts each terminate in a pin receiving socket located within a corresponding one of said second transverse apertures.

* * * * *